United States Patent [19]

Pujol

[11] 4,066,215

[45] Jan. 3, 1978

[54] DISC FOR GRINDER

[76] Inventor: Carlos Oliver Pujol, Marina St. No. 51, Badalona (Barcelona), Spain

[21] Appl. No.: 733,359

[22] Filed: Oct. 18, 1976

[30] Foreign Application Priority Data

July 13, 1976 Spain ..... 222298

[51] Int. Cl.[2] ..... B02C 23/36

[52] U.S. Cl. ..... 241/46.11; 241/172

[58] Field of Search ..... 241/46.11, 46.15, 74, 241/172, 296, 297

[56] References Cited

U.S. PATENT DOCUMENTS

| | | | |
|---|---|---|---|
| 3,050,263 | 8/1962 | Barkman et al. | 241/172 |
| 3,199,792 | 8/1965 | Norris, Jr. | 241/172 |
| 3,826,435 | 7/1974 | Pujol | 241/172 |

FOREIGN PATENT DOCUMENTS

| | | | |
|---|---|---|---|
| 1,336,193 | 8/1972 | United Kingdom | 241/172 |

*Primary Examiner*—Granville Y. Custer, Jr.
*Attorney, Agent, or Firm*—Blanchard, Flynn, Thiel, Boutell & Tanis

[57] ABSTRACT

An improved grinding disc, especially devised for mounting on the agitating shaft of a cooled grinder for the predispersion of solids in liquids. The disc has a plurality of apertures therethrough, preferably three in number, which apertures have an inclined outlet edge. When a determined number of discs are mounted on an agitating shaft of a vat with counterpositioned orientation such that the inclinations of the outlet edges of successive discs are directed in opposing directions, opposing currents are created which notably improve the dispersion of solids in liquids.

2 Claims, 6 Drawing Figures

Fig. 2
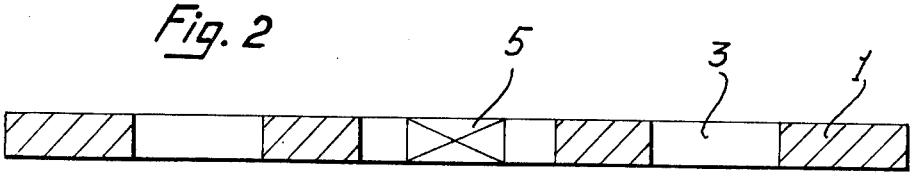
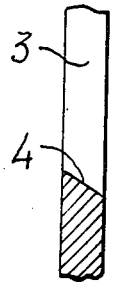
Fig. 3
Fig. 1
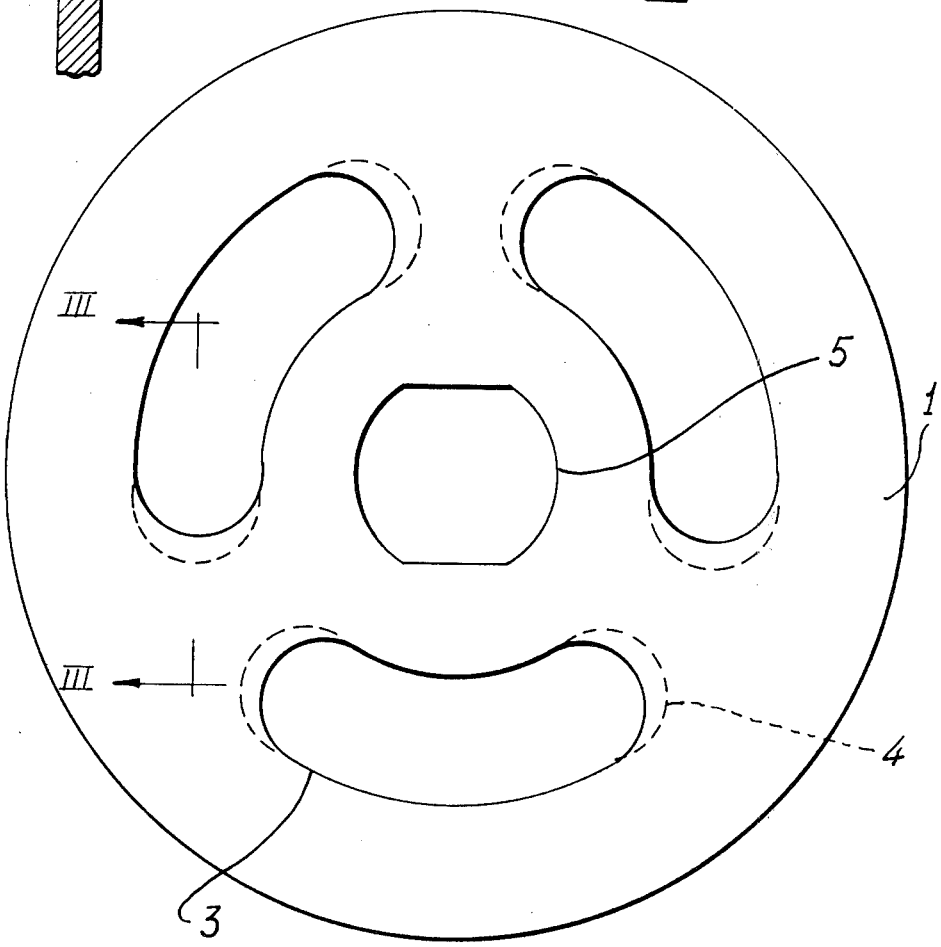

DISC FOR GRINDER

SUMMARY OF THE INVENTION

The present invention relates to an improved grinding disc.

More concretely, grinding discs of this invention are designed to be linked to the agitating shaft of cooled grinders for the predispersion of solids in liquids. In general terms, these discs are provided with apertures having chamfered outlet edges, and are adapted for mounting on the agitating shaft of a horizontal or vertical-type vat.

The disc referred to, as has previously been indicated, have apertures which provide drag and circulation for the grinding elements (for example, balls) which pass through them. The number of apertures with which each disc is equipped is, preferably, three. The periphery of the discs can be smooth and, as an alternative realization, can have four planes, in two sets of opposing pairs, with the object of obtaining a greater impetus when dealing with the dispersal of pigments of greater resilience.

The discs described are designed to be mounted on the agitating shaft, in counterposition, in such a way that the outlet edge of the aperture on one disc is adjacent to the inlet edge on the next disc, with the object of creating opposing currents which improve the dispersion of solids in liquids.

The discs of this invention are particularly suited for use on a grinder of the type described in my copending applications Ser. Nos. 729,298 and 729,299.

BRIEF DESCRIPTION OF THE DRAWINGS

FIGS. 1 and 2 correspond respectively to a planar view and a sectional view through a diameter of the disc.

FIG. 3 is a detail in section of a view along the line III—III in FIG. 1.

DETAILED DESCRIPTION

Figure 5:
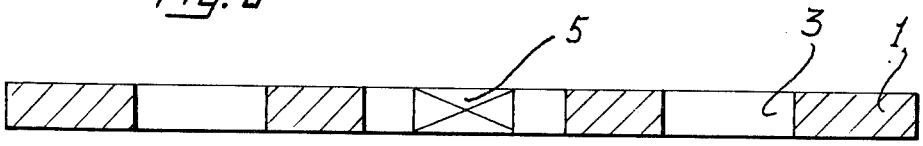
FIGS. 4 and 5 are, respectively, planar and sectional views of a variation of the disc.
Figure 4:
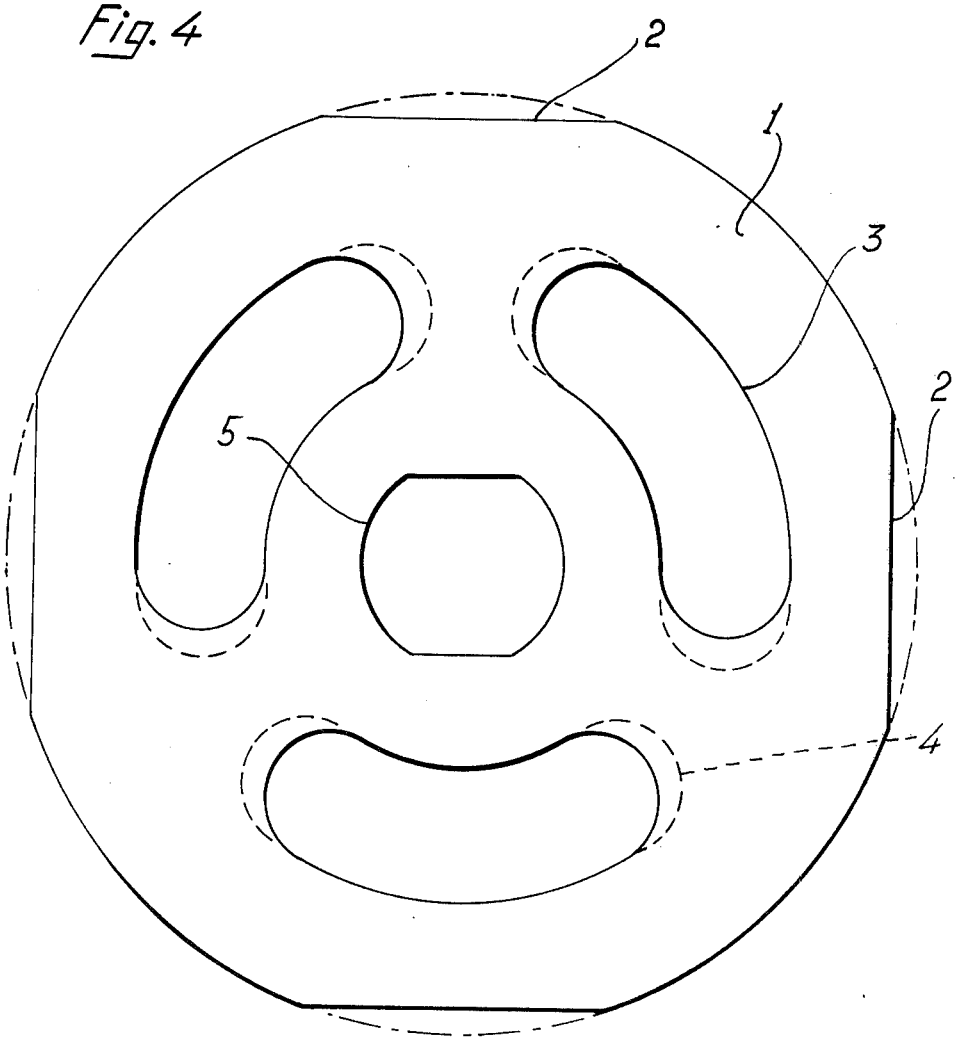

With reference to the figures, there is illustrated a grinding device equipped with discs 1 (FIG. 1) which, as shown in FIG. 4, may be provided with planar side edges 2.

The discs 1 are equipped with apertures 3 therethrough, which apertures provide drag and circulation for the grinding elements which pass through them. As illustrated, each disc preferably has three apertures therethrough. The apertures comprise elongated arcuate slots which are equally angularly spaced apart and are generated about the rotational center of the disc.

Figure 6:
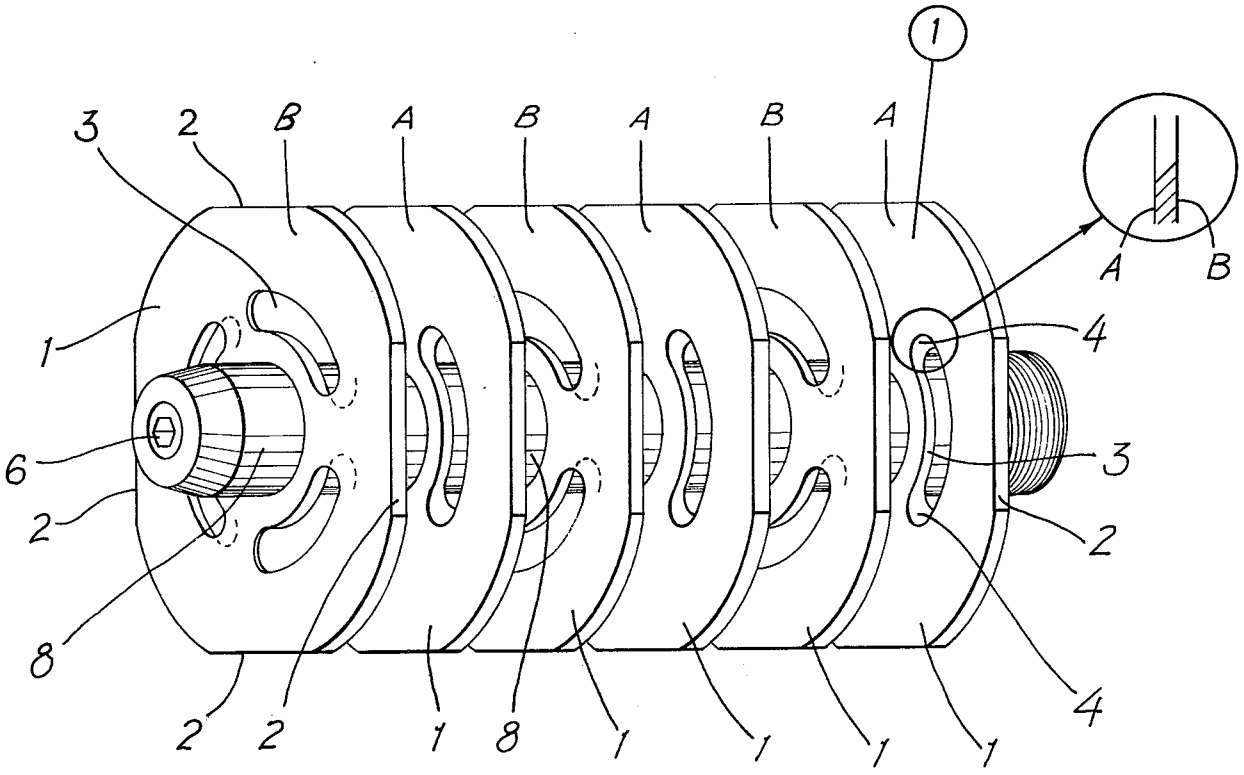
FIG. 6 shows, in a schematic fashion, a longitudinal section of the grinder, from which may be appreciated the mounting system for the discs.

These apertures 3 have chamfered outlet edges 4 in such a way that when the discs are mounted on the axle such as illustrated in FIG. 6, opposing currents are created which notably improve the dispersion of solids in liquids. Particularly, as shown in FIG. 6, the discs 1 are mounted in opposed pairs so that the identical faces A or B are directly opposite one another. This results in the slots of the adjacent discs being angularly offset by 180° relative to one another whereby the trailing edges 4 of the slots 3 in one disc are approximately aligned with the leading edges of the slots in the adjacent disc. This positioning of the discs in opposed pairs thus results in the slots in the alternate discs A being aligned with the solid regions on the intermediate discs B as located between the adjacent slots thereof, and vice versa. The slots in the adjacent discs are thus alternately offset throughout the stack of discs.

The discs 1 are provided with a central orifice 5 for mounting on the rotatable agitating shaft 6 of a vat, which in the concrete case of the example is a horizontal type, although it may equally well be a vertical vat. Separator sleeves 8 may be interspersed between the discs.

The model in essence, can be implemented in other forms which may differ in detail from that outlined by way of an example in the description, which forms will be equally capable of achieving the type of protection sought. Thus it may be constructed in whatever shape or form, with the materials most suitable to each case, while all of this remains encompassed within the spirit of the claims.

The embodiments of the invention in which an exclusive property or privilege is claimed are defined as follows:

1. In a grinder, such as a ball mill, for the dispersion of solids in liquids, said grinder having a rotatable grinding structure formed by a rotable shaft and a plurality of grinding discs fixed to said shaft in perpendicular and axially spaced relationship thereto, said grinding structure being rotatable about the axis of said shaft, comprising the improvement wherein said plurality of discs are identical and each includes a plurality of elongated arcuate slots which are equally angularly spaced apart along a circular path generated about the rotational axis, said elongated arcuate slots also being generated about said rotational axis and extending axially through said disc, the elongated slots of each said disc having end walls defining the opposite ends of the slot, said end walls defining the leading and trailing edges of each slot when the disc is rotated, the pair of end walls as defining the opposite ends of each said slot being sloped in opposite directions relative to the rotational axis so that the slot terminates in an elongated opening formed in one face of the disc which is larger than the elongated opening formed by the slot in the other face of the disc, and said discs being mounted on said shaft in opposed axially spaced pairs with the discs of each said pair themselves being axially spaced apart, the discs of each said pair being disposed with said one faces thereof directed toward one another, and said plurality of axially spaced discs being positioned so that the slots in the axially adjacent discs are alternately angularly offset so that the slots as formed in any two adjacent discs are not axially aligned.

2. A grinder according to claim 1, wherein each of said discs has only three of said elongated angularly spaced slots formed therein, and wherein each said disc has four planer side edges which are uniformly spaced apart around the periphery of the disc and are individually joined together by arcuate side edges which are generated substantially about said rotational axis.

* * * * *